United States Patent [19]

Marman et al.

[11] Patent Number: 5,026,990

[45] Date of Patent: Jun. 25, 1991

[54] METHOD AND APPARATUS FOR INSTALLING INFRARED SENSORS IN INTRUSION DETECTION SYSTEMS

[75] Inventors: Douglas H. Marman, Ridgefield, Wash.; Robert C. Winters, Lake Oswego, Oreg.

[73] Assignee: Sentrol, Inc., Portland, Oreg.

[21] Appl. No.: 399,629

[22] Filed: Aug. 28, 1989

[51] Int. Cl.[5] ..... G08B 13/18

[52] U.S. Cl. ..... 250/342; 250/353

[58] Field of Search ..... 250/342, 353

[56] References Cited

U.S. PATENT DOCUMENTS 4,551,711 11/1985 Akiyama et al. ..... 250/342

4,642,454 2/1987 Carlson ..... 250/342

*Primary Examiner*—Carolyn E. Fields

*Attorney, Agent, or Firm*—Chernoff, Vilhauer, McClung & Stenzel

[57] ABSTRACT

Apparatus and a method for previewing the field of coverage of an infrared sensor and, accordingly, adjusting its position for use in an intrusion detection alarm system. A mirror can be mounted in place of the infrared sensor and has indicia corresponding to beams of sensitivity of the infrared sensor to provide an indication of the beams of sensitivity superimposed on an image reflected by the mirror to aid in adjusting the position of the infrared sensor. Alternatively, or as verification of the sensor position, a photograph can be prepared by use of a camera located in a proposed infrared sensor position. Directional beams of sensitivity of the infrared sensor are plotted on the photograph by the use of a prepared transparent overlay showing the correspondence between areas of the photograph and respective elements of the lens of the infrared sensor. Portions of the sensor lens are masked to block reception of infrared radiation from known sources along beams of sensitivity of the infrared sensor.

46 Claims, 12 Drawing Sheets

METHOD AND APPARATUS FOR INSTALLING INFRARED SENSORS IN INTRUSION DETECTION SYSTEMS

BACKGROUND OF THE INVENTION

The present invention relates to intrusion detection devices, and particularly to a method and apparatus for use in installing an infrared sensor as part of an intrusion detection system in such a way that it will not be affected adversely by the presence of heat sources such as lamps, windows, and heating system outlets and radiators.

Passive infrared sensors incorporating film, crystal, or ceramic pyroelectric detectors as sensitive elements are well known for use in detecting intruders in protected spaces. The body heat of a person moving through the zone of coverage of such an infrared sensor is sufficient for detection. However, any surface or object which can change temperature rather quickly, such as an incandescent lamp, a hot air register, furnace radiator, or exposed window can also be the source of sufficient infrared radiation to be detected by such a sensor. Such infrared radiation can trigger an alarm response unless provision has been made for preventing infrared radiation from such known sources from reaching the sensitive element of the infrared sensor.

In the past it has been difficult and time-consuming to determine clearly whether the field of coverage of any individual infrared sensor will be adequate to protect a space in which the sensor is to be located. Similarly, it has previously been difficult to determine except by trial and error testing whether incidental heat sources within a space to be protected by an infrared sensor are likely to cause problems. In the past installation of intrusion detection system infrared sensors has therefore been largely by trial and error installation of each sensor, with no way to preview accurately what potential sources of infrared radiation of no interest are located where they might be sensed by the intrusion detector system's passive infrared sensors. An experienced installer would place an infrared sensor in a location where good results were expected, but a "walk-through" test would then have to be performed to discover the actual location of the areas or beams of sensitivity of the infrared sensor, and thus to determine whether the coverage of the sensor or combination of sensors was satisfactory to detect the presence of an intruder in the space being protected.

As an improvement on such trial and error methods of installation, Mudge U.S. Pat. No. 4,275,303 teaches the use of a lamp to shine beams of visible light back through the lens of an infrared sensor. The sensor can be moved until the beam of light is visible to a person located in a zone where coverage is desired.

Carlson U.S. Pat. No. 4,642,454 teaches the use of a mirror in conjunction with an infrared sensor to view the fields of coverage of an infrared sensor through the lens of the sensor. Many infrared lenses, however, are opaque to visible light, and the Carlson invention is thus useless for infrared sensors including such lenses.

Cohen et al. U.S. Pat. No. 3,924,120 discloses an infrared detector utilizing a memory system to detect changes in the infrared radiation within a field covered by the detector. Such a system, however, is relatively complex and could not easily be utilized in the process of installing infrared sensors of the type commonly used in intrusion detection alarm systems.

Pistor U.S. Pat. No. 4,760,267 discloses a way of providing a black and white photograph of the pattern of infrared radiation received by an infrared sensor. The Pistor teachings, however, do not seem to be applicable to use during installation of an infrared sensor, in part because of the amount of time required.

Bechet et al. U.S. Pat. No. 4,773,752 discloses transmission of visible light to a television camera associated with an infrared camera utilized in a motion-stablizied infrared-detecting sighting device useful in controlling weapons. It is not clear how such a system could be used in installation of infrared sensors in intrusion detection systems.

Macall U.S. Pat. No. 4,081,678 discloses a system for viewing visible light along the same objective axis as an infrared optical system utilized as a temperature detecting device, but does not disclose how the system could be utilized in connection with intrusion detection systems.

Scofield U.S. Pat. No. 4,709,153, Keller-Steinbach U.S. Pat. No. 4,523,095, Stauffer U.S. Pat. No. 4,317,992 and Ariessohn et al. U.S. Pat. No. 4,539,588 also refer to infrared radiation sensors, but are not directly related to the problem of proper and effective installation of infrared sensors as part of intrusion detection systems.

What is still needed, then, is a method and apparatus for quickly, reliably, and simply determining whether a proposed location and orientation are appropriate for mounting of a passive infrared sensor as a part of an intrusion detection system, or whether such a proposed location or orientation result in reception of infrared radiation which would interfere with effective operation of such a sensor. Additionally, an easy and effective method is desired for making such an infrared sensor insensitive to known sources of infrared radiation which cannot be avoided practically by mounting the infrared sensor in a different location.

SUMMARY OF THE INVENTION

The present invention overcomes the aforementioned shortcomings of the previously used methods and devices for determining an appropriate location for mounting an infrared sensor as a part of an intrusion detection system, by providing a method and apparatus which enable a proposed sensor location for an infrared sensor to be evaluated quickly and easily. The invention also enables an installer to prepare an infrared sensor so that it is insensitive to recognized but unavoidable stationary sources of infrared radiation, yet remains useful to detect infrared radiation from other locations.

In accordance with the present invention the field of view of an infrared sensor is previewed using apparatus which forms a part of the present invention, so that the installer can see whether any heat sources lie in any of the directional beams of sensitivity of the infrared sensor. This can be accomplished quickly and easily using a mirror attached to a mounting assembly for the infrared sensor in a predetermined position relative to the position of the mounted sensor.

An alignment device may be provided to aid the installer in viewing the mirror from the proper perspective, and indicia are provided on the mirror to indicate the location of each directional beam of sensitivity of the infrared sensor, as determined by the combination of the sensor's sensitive element and internal optics, including the lens. Preferably, an outline indicating each beam of sensitivity is visible to the installer, superimposed upon the mirror image of the area to be monitored by the infrared sensor.

In a preferred embodiment a convex mirror is used, and an auxiliary mounting device holds the mirror, so that the mounting assembly for the infrared sensor can be adjusted, changing the position of the mirror and the ultimate position of the infrared sensor, while the mirror remains in place as a guide to adjustment of the mounting assembly for the infrared sensor.

As an alternative or complementary embodiment of the invention, a photographic image is prepared, preferably by the use of a simple camera mounted at a proposed infrared sensor location in a proposed orientation of the sensor. Thereafter, the beams of sensitivity of the infrared sensor are plotted on the photographic image, which is then inspected to determine whether any sources of infrared radiation are located within the plotted beams of sensitivity of the infrared sensing device. In accordance with the preferred method of carrying out the invention, the location of each beam of sensitivity of the sensor is plotted on the photographic image by the use of a transparent overlay on which the outline of each beam of sensitivity of the infrared sensor has been previously plotted for the particular combination of camera, infrared sensor, and sensor optics. This photographic image can be used to record the installation of an infrared sensor.

If a proposed sensor location and orientation appear to result in an unacceptably sparse coverage by sensor lens element beams which are not directed toward interfering sources of infrared radiation, the mirror image or the photographic image will be useful to suggest another sensor orientation or location. Another sensor orientation or location can then be studied to locate sources of infrared radiation likely to interfere with operation of the infrared sensor, with the process being repeated until a satisfactory location for the infrared sensor is chosen, but with much less time required than by trial-and-error installation and walk-through testing of a sensor.

Once a proposed location has been chosen, if there remains any source of infrared radiation which is likely to impinge upon the infrared sensor in such a way as to interfere with proper detection of an intruder, the path of such infrared radiation from the identified probable source of infrared radiation is blocked in the sensor. Preferably, the path of such undesired infrared radiation is blocked by placing infrared-opaque mask elements in proper alignment with the infrared lens of the sensor. In accordance with the present invention a clear indication may be provided of the correspondence between the indicia on the mirror, or the plotted areas on the photographic image, and particular elements of the infrared lens used to define respective beams of sensitivity to infrared radiation. This correspondence is then used to determine which portions of the infrared lens need to be masked, if any. Standardized masks can be provided for use for generally common types of sensor locations, leaving the sensor insensitive to expected infrared radiation coming from certain angles, such as would be normal when a sensor is to be used at one end of a hallway, or to monitor a space in which baseboard heating elements are provided along a wall opposite the location of an infrared sensor.

It is therefore a principal object of the present invention to provide an improved method and apparatus for use in determining an acceptable location for a passive infrared sensor as a part of an intrusion detection alarm system.

It is another important object of the present invention to provide an apparatus and a method for preparing an infrared sensing device for use as a part of an intrusion detection system in which an infrared sensor must be mounted in a location where there are identifiable sources of infrared radiation which might interfere with the infrared sensor's ability to detect intruders.

An important feature of the invention is the use of a mirror including indicia identifying beams of sensitivity as visible in a reflected image to preview an area to be protected by an infrared sensor.

Another important feature of the method of the present invention is the preparation of a photographic image by gathering light at a proposed infrared sensor location, and then plotting a correspondence between the photographic image and the field of coverage of the infrared sensor, to determine by examination of the photographic image whether potential or definite sources of infrared radiation identifiable in the image are likely to interfere unacceptably with effective operation of the infrared sensor.

It is yet another important feature of the present invention to provide a method for masking a portion of the sensor to prevent infrared radiation from reaching the sensitive element of an infrared sensor from identified sources of infrared radiation, so that the infrared sensor will remain sensitive to the body heat of an intruder but not be sensitive to the identified sources of infrared radiation.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
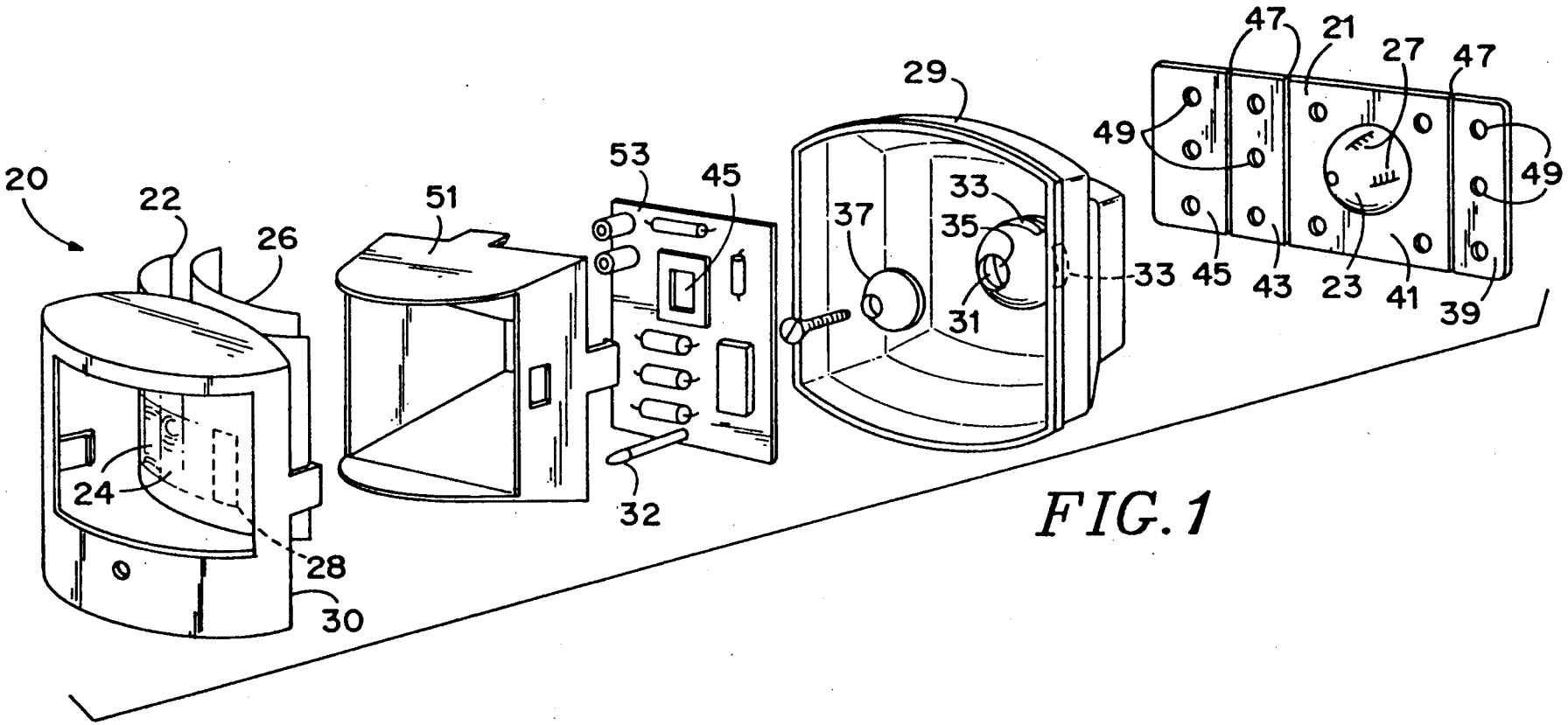
FIG. 1 is an exploded view of an infrared sensor for use in an intrusion detection system and with which the present invention may be used.

Referring now to the drawings, in FIG. 1 a passive infrared sensor unit 20 is supported by a mounting bracket 21 which is adaptable to be mounted conveniently in a corner of a room or on a wall, oriented either directed perpendicularly away from or forming an acute angle with the wall. Usually the bracket 21 will be in a location several feet above the floor, leaving the sensor 20 generally unobstructed and thus able to sense the infrared radiation of body heat of an intruder moving within the field of coverage of the infrared sensor 20. The bracket 21 includes a hemispherical protrusion or ball 23 on which position scale marks 27 are provided. A receiver 29 defines a socket portion 31 which fits matingly on the ball 23 and defines windows 33 through which the scale marks 27 are visible to indicate alignment of the socket 31 relative to the ball 23. A large central opening 35 in the socket portion 31 allows it to move relative to the ball, while a retainer 37 is fastened to the ball 23 by a screw to clamp the ball 23 and socket 31 together once adjusted to a particular orientation.

Figure 3:
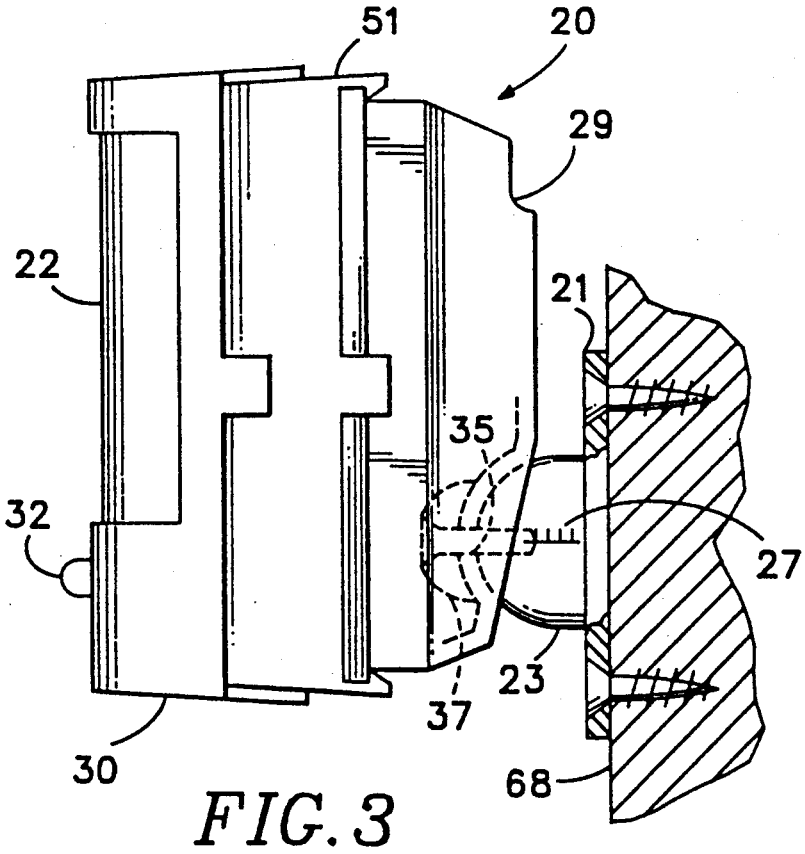
FIG. 3 is a side elevational view of the infrared sensor shown in FIGS. 1 and 2.
Figure 4:
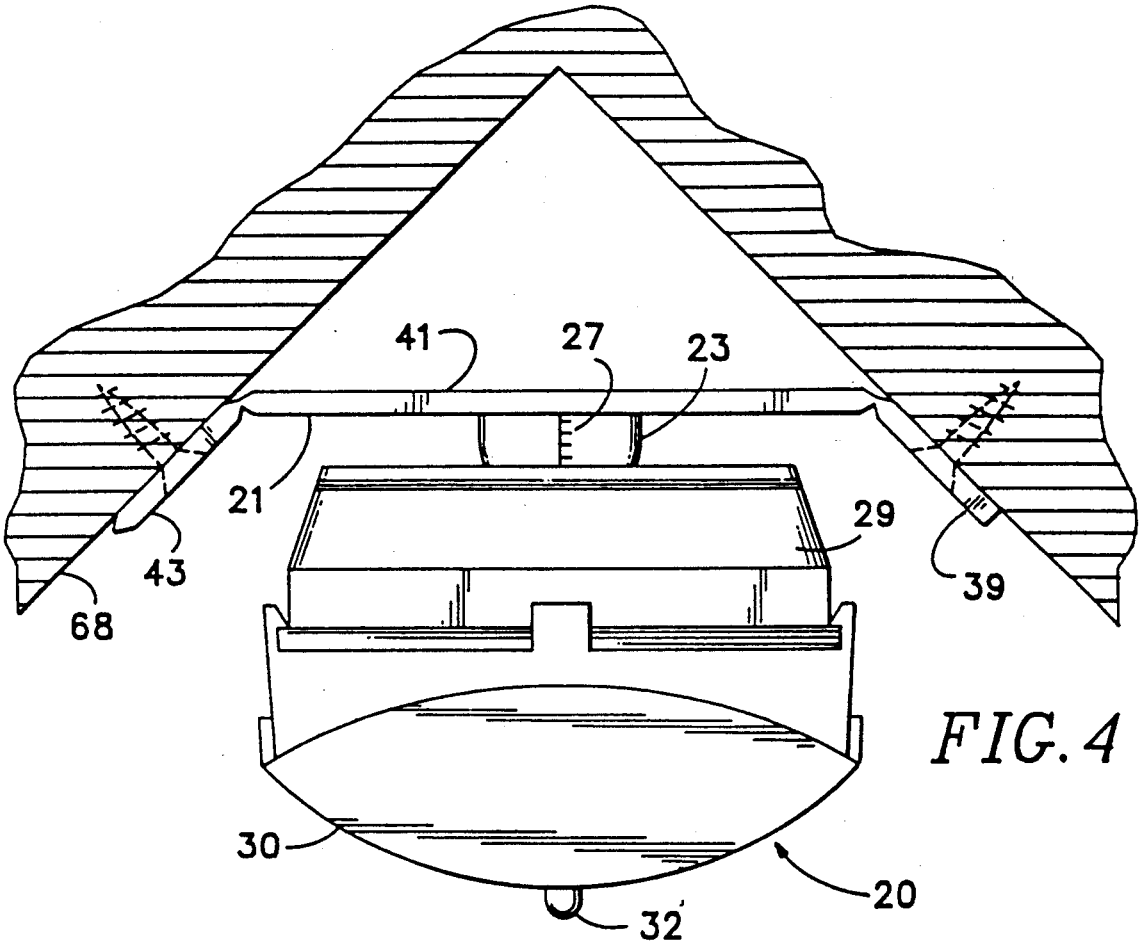
FIG. 4 is a top plan view, at a reduced scale, showing the infrared sensor shown in FIGS. 1-3 installed in a corner defined by a pair of walls of a room.
Figure 5:
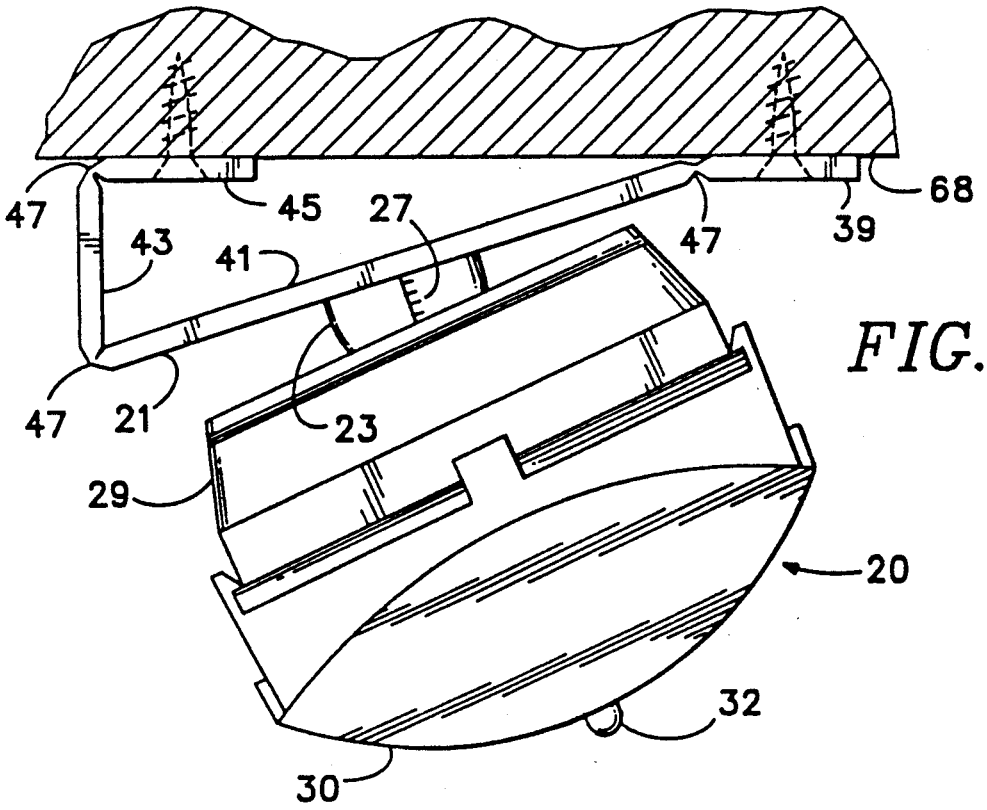
FIG. 5 is a top plan view showing the infrared sensor shown in FIG. 1 mounted on a wall in an angularly offset position.

The bracket 21 includes four segments 39, 41, 43 and 45 interconnected flexibly as by the entire bracket 21 being molded of a suitable plastic material defining live hinges 47 as thin areas of the plastic material. Each of the segments 39, 41, 43 and 45 defines apertures 49 to receive fasteners such as mounting screws. By appropriate flexure of the hinges 47 the bracket 21 can be mounted in a corner as shown in FIG. 4, or at an acute angle to a wall, as shown in FIG. 5. Segments 39 and 43 can be cut free from the segment 41 and discarded when mounting the bracket against a flat wall as shown in FIG. 3.

A compound lens 22, shown in FIG. 1 removed from its normal mounting position in the front of the infrared sensor 20, includes a plurality of Fresnel lens elements 24, which are preferably formed on the rear side of the compound lens 22 by an appropriate molding process during manufacture of the compound lens 22. The compound lens 22 may be, preferably, of a self-supporting but resiliently flexible plastic sheet material, which may be opaque to visible light, but is transparent to infrared light. The compound lens 22 is flexible enough to fit in an arcuate configuration inside a cover 30 and is shown in greater detail in FIG. 15. Each of the Fresnel lens elements 24 focuses infrared radiation received from an appropriate direction onto a sensitive element 25 contained within the passive infrared sensor. The sensitive element 25 may be of the Piezo-electric film, crystal, or ceramic pyrometer type. Thus, each Fresnel lens elements 24 defines a respective beam of sensitivity extending away from the infrared sensor 20 and along which infrared radiation may travel toward the infrared sensor 20 to be focused onto the sensitive element of the infrared sensor 20 by a respective Fresnel lens element 24.

One or more infrared-opaque mask elements 28 may be attached adhesively to appropriate elements of the compound lens 22, as will be explained more fully subsequently, in order to block reception of infrared radiation by the sensitive element 25 of the infrared sensor 20, if such infrared radiation originates from a source such as a hot air register, a heating system radiator, an incandescent lamp, or other known source of heat whose detection by the infrared sensor 20 might be interpreted mistakenly by the sensor 20 as indicating the presence of an intruder within its field of view.

An optional lens mask 26, located adjacent the compound lens 22, may also be manufactured of a suitable resiliently self-supporting sheet plastics material which is transparent to infrared radiation. The infrared-opaque mask elements 28 may be attached to the lens mask 26 in certain locations, instead of being attached directly to the lens 22.

Figure 2:
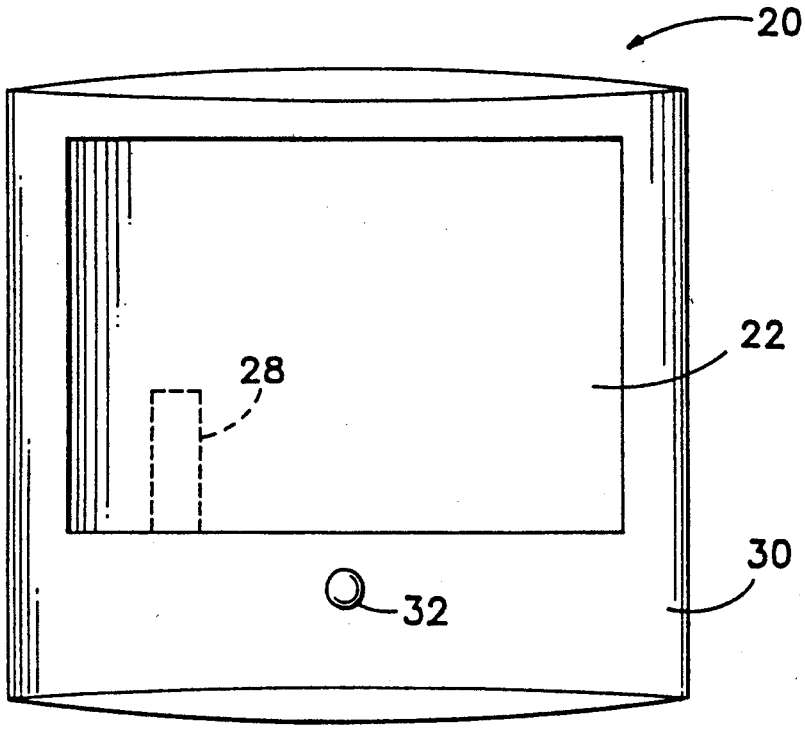
FIG. 2 is a front view of the infrared sensor shown in FIG. 1.

A cover 30, preferably molded of a plastic material, holds the compound lens 22 (and the lens mask 26, if present) against a rear housing 51, which encloses the electronic circuitry 53 of the sensor 20, as may be seen in FIGS. 1, 2 and 3.

An indicator lamp 32, such as a light-emitting diode, may be provided to give a visible indication that the infrared sensor 20 has received infrared radiation in a manner indicating the presence of an intruder within its field of view.

Figure 6:
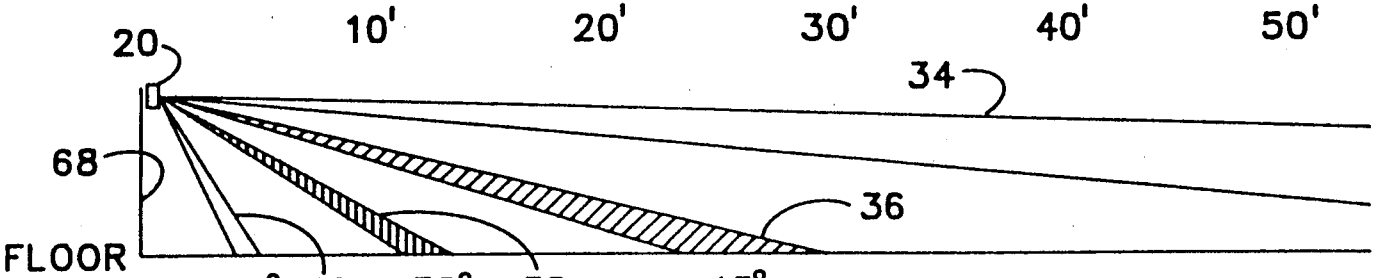
FIG. 6 is a schematic side view showing a plurality of beams of sensitivity of the intrusion detection infrared sensor shown in FIGS. 1-4.
Figure 7:
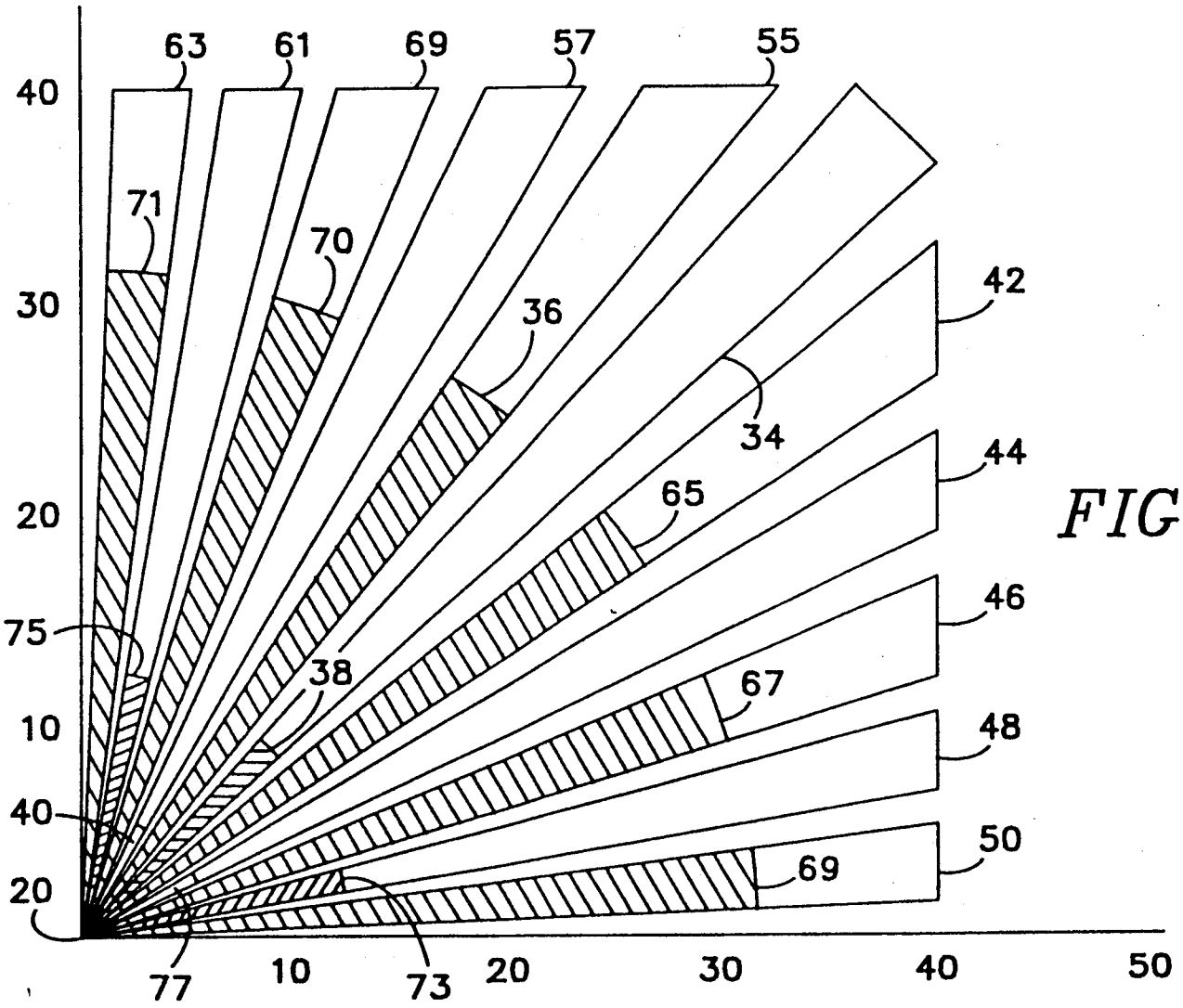
FIG. 7 is a schematic top plan view showing a plurality of beams of sensitivity of the infrared sensor shown in FIGS. 1-5.

Typically, the infrared sensor 20 has a zone of coverage consisting of several narrow beams of sensitivity distributed over angles of slightly less than 90° in both vertical and horizontal planes, as shown in FIGS. 6 and 7. FIG. 6 shows, for example, a side view of the arrangement of representative beams of sensitivity 34, 36, 38, and 40. Each beam of sensitivity is a zone of space extending away from the Fresnel lens 22, defined by a respective one of the Fresnel lens elements 24 which are arranged in two horizontal rows in the compound lens 22 as shown in more detail in FIG. 15. Each lens element 24 focuses infrared radiation received from sources located within a respective beam of sensitivity onto the sensitive element 25 of the infrared sensor 20. Infrared radiation from locations outside any of the beams of sensitivity would, on the other hand, not be focused upon the sensitive element 25.

FIG. 7 shows a diagrammatic top view of the beams of sensitivity defined by the Fresnel lens elements 24 of the compound lens 22, with the sensor 20 mounted in a corner, at a height of about 7½ feet and directed horizontally, in the normal or base position of the socket 31 relative to the ball 23. A top row of beams of sensitivity thus includes the beam 34, as well as additional narrow beams of sensitivity 42, 44, 46, 48, 50, 52, 55, 57, 59, 61 and 63 in a fan-like array of beams of sensitivity directed slightly below horizontal. Similarly, the individual Fresnel lens elements 24 in the lower horizontal row of lens elements 24 on the compound lens 22 define similar beams of sensitivity 36, 38, 40, 65, 67, 69, 70, 71, 73, 76 and 77 at further depressed angles, as shown in FIGS. 6 and 7.

Figure 8:
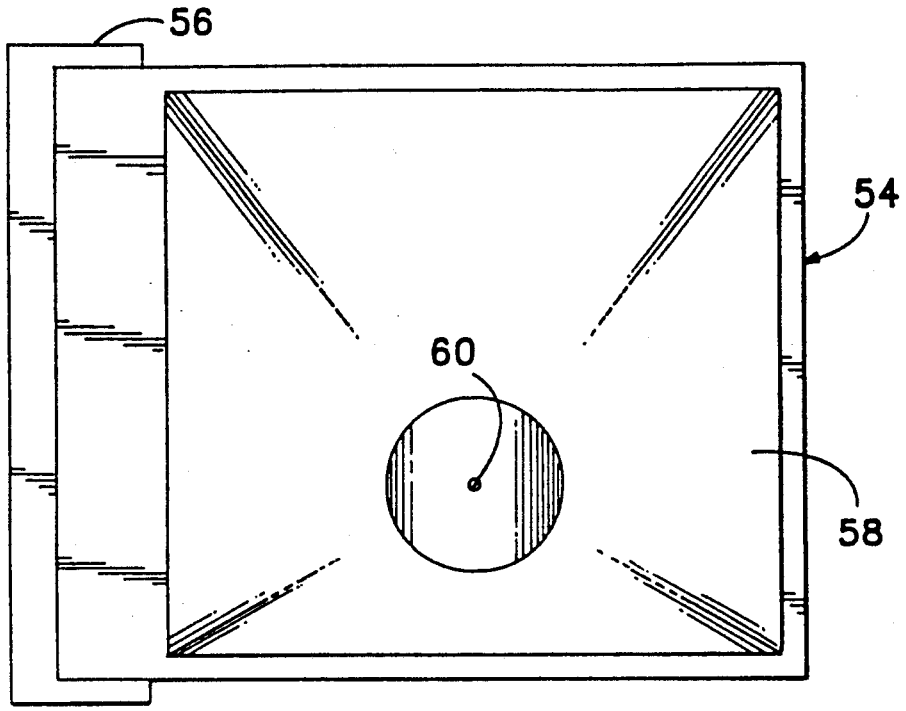
FIG. 8 is a front view of a simple camera useful in accordance with the present invention.
Figure 9:
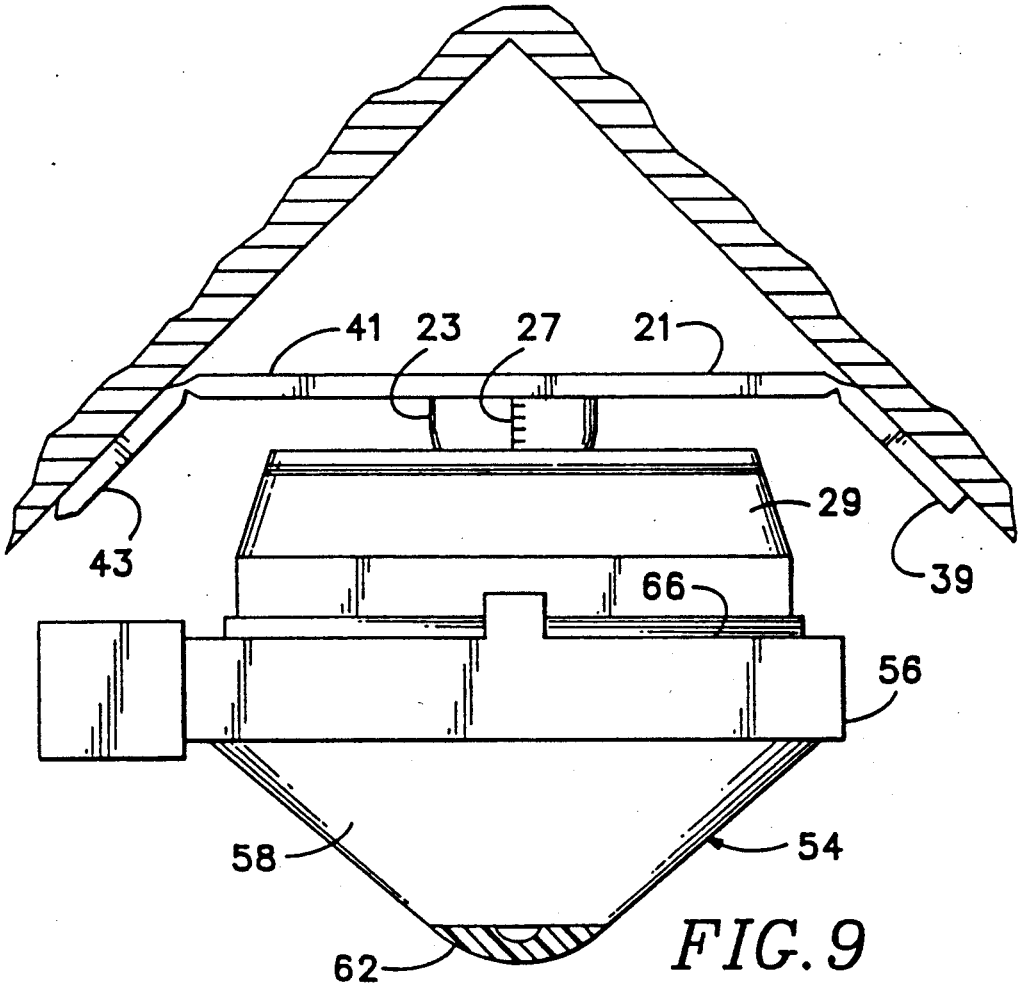
FIG. 9 is a schematic top plan view of the camera shown in FIG. 8 being used in accordance with the invention to evaluate infrared sensor coverage from a position in a corner of a room.
Figure 10:
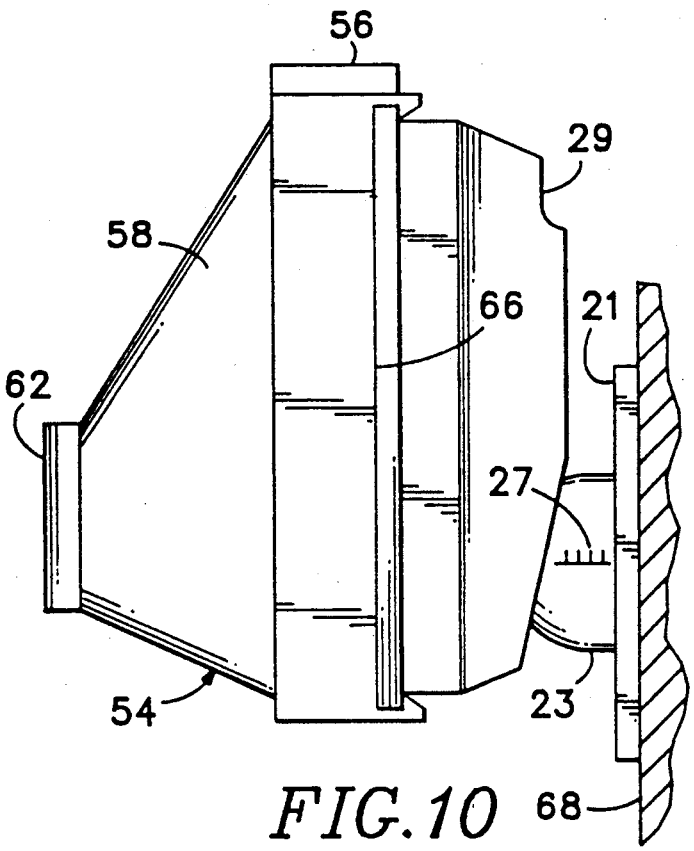
FIG. 10 is a side elevational view showing the camera of FIGS. 8 and 9 located against one wall of a room.

Referring to FIGS. 8, 9 and 10, a camera 54 includes a camera back 56 including a rear portion removably mounted in the receiver 29, as by a resilient snap fit, in the same manner in which the sensor unit 20 also fits into the receiver 29. A simple front body 58 of the camera has a pinhole aperture 60, in order to obtain a wide angle photograph sharply focused on the film, regardless of each object's distance from the camera 54. For example, the pinhole 60 could be defined in a thin sheet of metal and could have a diameter of about 0.020 inch. The pinhole 60 is located below mid height of the film in the film carrier back 56 so that the generally downwardly sloped field of view of the sensor unit 20 is imitated by the camera.

The camera 54 is equipped appropriately to utilize self-printing "instant" film, such as high-speed Polaroid TM Professional film No. 667, having a sensitivity of ISO-3000/36°, which may be used in a Polaroid TM film carrier camera back 56. Using such film, an adequate exposure can be obtained by uncovering the pinhole 60 for a period of about five seconds, in ordinary interior light levels. A simple shutter, whose design is not part of this invention, may be associated with the pinhole aperture 60 to control exposure of the film in the film carrier 56.

Optionally, where it is desired to obtain a photograph of wider angular coverage than is provided by the pinhole 60, a lens may be used with the camera, although the aperture should be kept small to preserve depth of field and make focus adjustment unnecessary. In particular, a cylindrical lens 62 may be used to 30 expand the angle of the camera's field of view in a horizontal plane without changing it in vertical plane.

The receiver 29 holds the camera 54 in the same directional orientation as it would hold the sensor 20. A definite correlation is thus established between the field of view of the camera 54 and the field of view of the sensor 20, when each is attached to the receiver 29.

Also, a surface 66, defined by the backside of the camera, is substantially parallel to the plane of the film held in the film carrier 56, so that when the camera is placed against the wall 68, the film will be oriented parallel with the wall 68, with the same orientation as that of the sensor 20 with the receiver 29 attached to the mounting bracket 21 in its basic or zeroed orientation of the socket 31 to the ball 23.

As a result, placing the camera 54 in a proposed sensor location,, preferably by mounting it in the receiver 29 by use of the ears 62 and sockets 64, or by placing it against the surface of a wall 68 in a proposed sensor location, permits a photograph to be made of the surrounding area from substantially the same perspective as that which the infrared sensor 20 would subsequently have. The use of a pinhole aperture 60, open for a long enough time to provide adequate exposure of the film used, provides a sharp photographic image of the room in which the camera is used, without depth of field limitations which would be present if a larger aperture were used. Use of the camera 54 equipped with the cylindrical lens 62 provides a wider perspective for the camera to correspond with the field of view of a compound infrared lens 22 arranged to provide a wider zone of coverage than is shown in FIG. 7.

Use of instant print film provides immediate viewing of the photographic image produced. It also eliminates the variation in the amount of cropping of the image which is shown in a print which might be produced as an enlargement from the exposed film, were ordinary negative film to be used and printed by ordinary film processing techniques. Thus, the resulting directly produced photographic image obtained through use of the camera 54 has a highly predictable relationship to the direction of each of the beams of sensitivity defined by the compound lens 22 of the infrared sensor 20. That is, there is a constant correlation between the angular orientation of each of the beams of sensitivity produced by a respective one of the Fresnel lens elements 24 of the compound lens 22 and a particular area depicted in a photographic image produced by the camera 54 when the film within the film carrier 56 is exposed to ordinary light through the pinhole 60 or the lens 62 with the camera 54 located where the infrared sensor 20 is proposed to be located.

In accordance with the present invention each of the beams of sensitivity defined by the elements of compound infrared lens of an infrared sensor corresponds to a particular area of a photographic image produced by a camera such as the camera 54 held in the same location as is proposed for the sensor 20. Each of the beams of sensitivity of a particular infrared sensor is then plotted on the photographic image produced by a camera held in the sensor location. The photographic image is then inspected visually to determine whether any beam of sensitivity of the infrared sensor as plotted includes a source of infrared radiation such as a lamp, hot air register, exposed window, or the like which would be likely to cause the sensor to give a false indication of the presence of an unauthorized person in the area protected by an intrusion detection system incorporating the infrared sensor.

For use of a given camera with a given type of infrared sensor incorporating a particular infrared lens, the correlation of sensor beams of sensitivity with photographic images need be plotted only once. The plotted correlation between a photographic image produced by the camera and the location of each beam of sensitivity of the infrared sensor can be recorded on a template, such as the transparent overlay 72 shown in FIG. 11. By the use of position references such as marks 74 and 76 provided on the overlay 72, a photographic image 78 produced by the camera 54 may be placed in a particular position with respect to the overlay 72. The overlay 72 preferably is of transparent flexible sheet material on which an outline 80 is permanently marked as an indication of each of the beams of sensitivity. Thus, by simply observing whether each source of infrared radiation depicted in the photographic image 78 is located within the outline 80 of a beam of sensitivity, it may be determined whether the corresponding beam of sensitivity of the infrared sensor 20 is likely to be affected adversely. That is, if the photographic image depicts a lamp located within the outline 80 corresponding to the beam of sensitivity defined by a particular Fresnel lens element 24 it will be apparent that that particular Fresnel lens element 24 is likely to focus infrared radiation on the sensitive element 25 when the lamp is in use.

Preferably, indicia 82 such as the alphabetical letters A, B, etc. are provided on the transparent flexible sheet of the overlay 72 to identify each of the outlines 80 specifically and thus to establish a correspondence with a particular one of the Fresnel lens elements 24, which may be identified by corresponding indicia on the lens 22.

Referring now also to FIGS. 13–16, it will be seen that the lens mask 26 is subdivided into small areas 84 and that the small areas 84 are identified by indicia 86 including letters of the alphabet corresponding to one of the indicia 82 of the transparent overlay 72.

Figure 12:
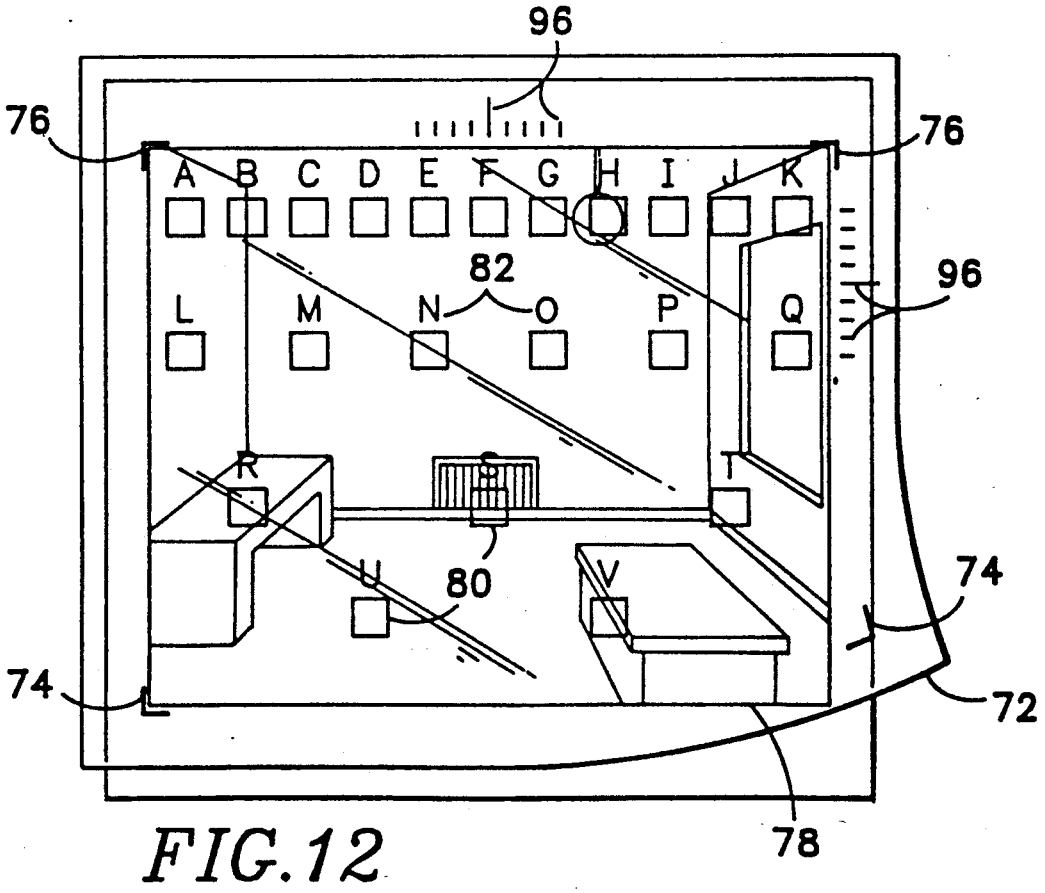
FIG. 12 is a pictorial view of the overlay device shown in FIG. 11 being used in accordance with the present invention in conjunction with a photograph taken using a camera such as that shown in FIGS. 8-10.
Figure 13:
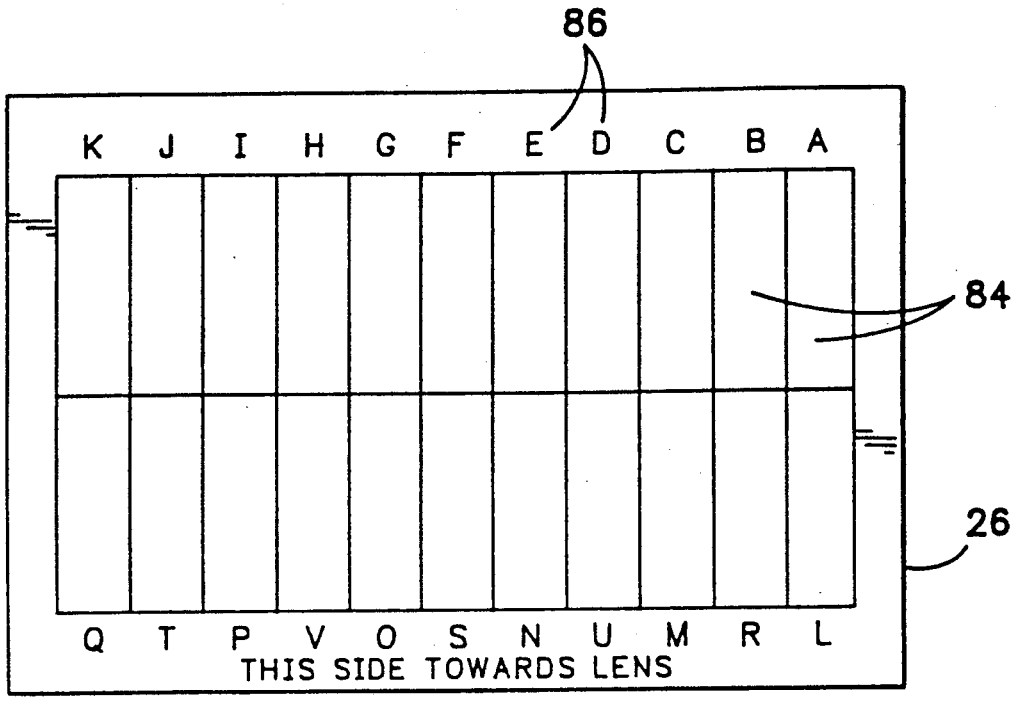
FIG. 13, is a pictorial view of a lens masking device useful in conjunction with the present invention.
Figure 14:
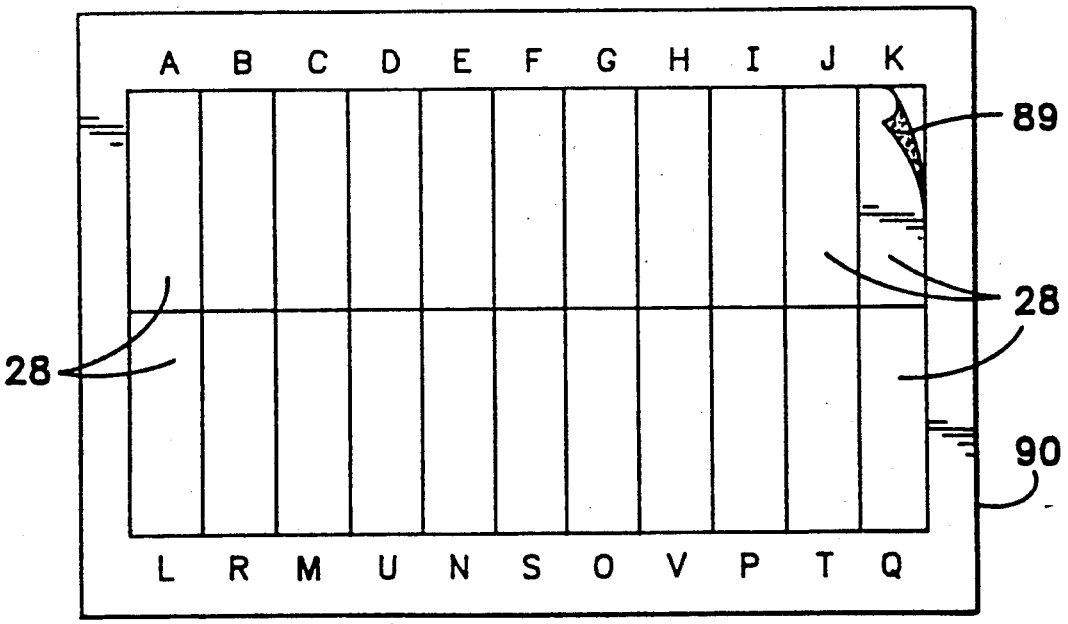
FIG. 14 is a pictorial view of a backed sheet of self-adhesive infrared-opaque material pre-cut into appropriately shaped segments for use in conjunction with the masking device shown in FIG. 13.

Several individual mask elements 28 each include an adhesive layer 89, ordinarily holding the self-adhesive mask elements 28 on a backing sheet 90 from which each element 28 is easily removable. Each of the mask elements 28 corresponds in shape and size to one of the elements 24 of the compound lens 22 and a corresponding one of the small areas 84 delineated on the lens mask 26 (if used) as shown in FIG. 12. Each of the mask elements 28 is of an infrared-opaque material such as a flexible black plastic sheet material.

Figure 11:
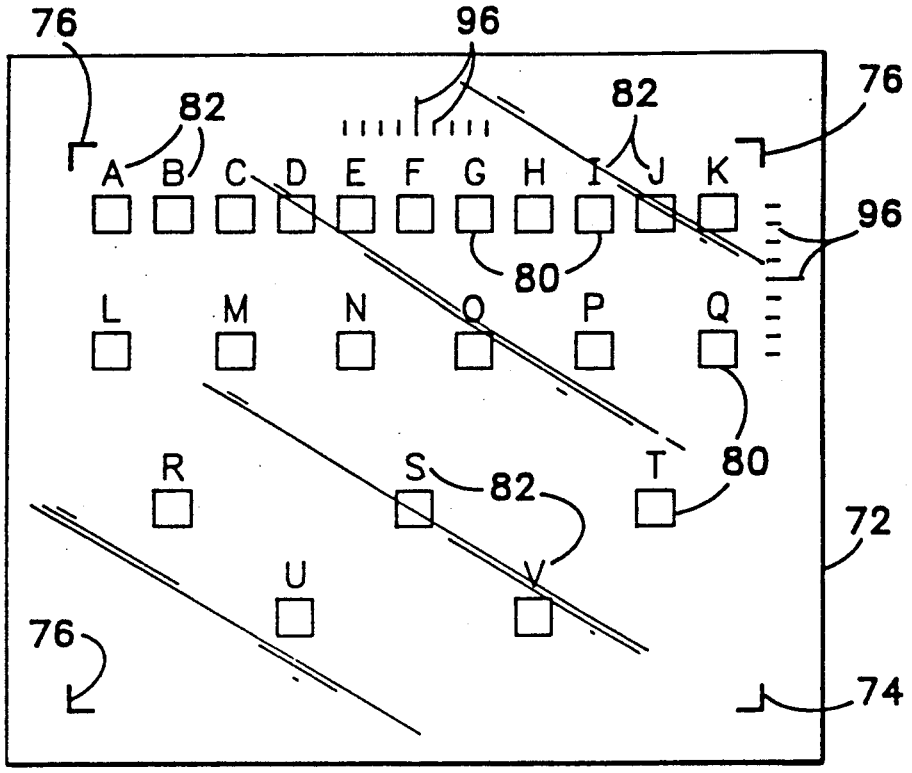
FIG. 11 is a pictorial view of an overlay device useful in accordance with the method of the present invention.

In accordance with the method of the present invention, then, the overlay 72 is aligned with the photographic image 78. A mask element 28 is applied either to the particular element 24 of the lens 22 bearing a corresponding letter indicium 88, or to a particular small area 84 of the lens mask 26, if present, bearing the letter indicium 86 corresponding to the indicium 82 which identifies a particular outline 80 which includes the photographic image of a source of infrared radiation likely to interfere with operation of the infrared sensor 20. The photographic image 78, as shown in FIG. 12, includes a lamp which falls within the outline 80 accompanied on the overlay 72 by the identifying letter H as the indicium 82 identifying one beam of sensitivity. Similarly, the hot air register falls within the outline 80 identified by the letter S as the indicium 82, and a window falls within the beam of sensitivity identified by the outline 80 associated with the indicium "Q." When the lens 22, or the mask 26 is prepared by the application of mask elements 28 to cover the appropriate lens elements 24, or when mask elements 28 are applied to the appropriate small areas 84 of the lens mask 26 which correspond to the outlines 80 bearing indicia "H," "S" and "Q" on the overlay 72, and the lens mask 26 is placed in proper alignment with the compound lens 22, the mask elements 28 will prevent infrared radiation from reaching the sensitive element 25 through the corresponding Fresnel lens elements 24. Thus, infrared radiation will be prevented from reaching the sensitive element 25 of the infrared sensor 20 from the lamp located within the beam of sensitivity labeled by the letter "H" as the indicium 82 of the overlay 72, as shown in FIG. 11, when the sensor 20 is mounted where the camera 54 was located when the photographic image 78 was taken. Similarly, infrared radiation from the hot air register located partially within the outline 80 indicated by the letter "S" as the indicium 82 will also be blocked from reaching the sensitive element 25 of the infrared sensor 20 through the compound lens 22 (and the lens mask 26 if used) when the masking elements 28 are placed properly on the compound lens 22 or lens mask 26.

With certain elements 24 of the compound lens 22 thus masked by elements 28 in response to examination of the photographic image 78, and with the passive infrared sensor 20 mounted in the location where the camera 54 was located when the photographic image 78 was made, the infrared sensor 20 will not be affected by radiation emanating from the lamp, the window, or the hot air register depicted in the photographic image 78.

Where the optional mask 26 is utilized, mask elements 28 would be applied to the particular small area or areas 84 of the mask 26 which bear indicia corresponding to the indicia on the overlay 72 identifying the particular outlines 80 of the beams of sensitivity as plotted on the photographic image 78, which include sources of potentially interfering infrared radiation. When the mask 26 is thereafter put in place adjacent the lens 22 and the sensor unit 20 is put in the position from which the camera 54 took the image 78, the mask 26 will prevent interfering infrared radiation from reaching the sensitive element 25 of the sensor 20 from such sources.

Figure 17:
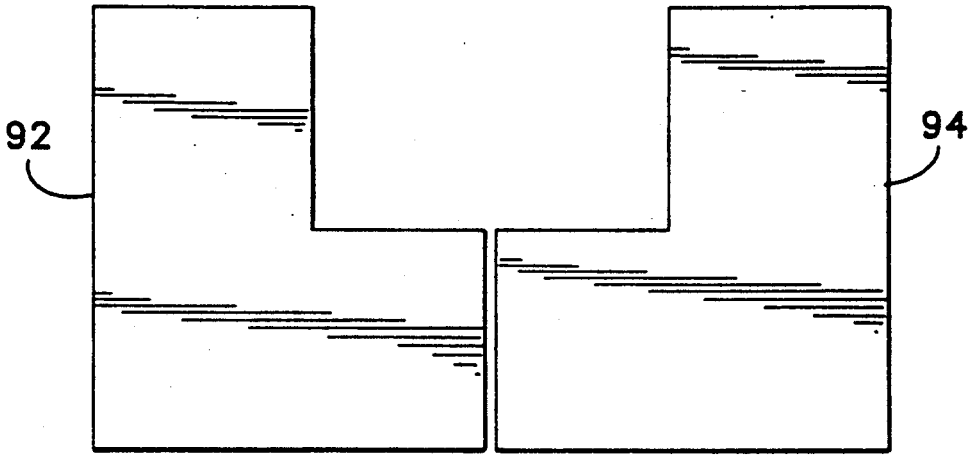
FIG. 17 is a view of a backed self-adhesive infrared-opaque masking sheet of a shape designed to provide a standardized reduction of the field of view of an infrared sensor of the type shown in FIGS. 1-5.

In some instances, for example where it is desired to provide infrared detection of intruders into a long narrow hallway by use of an intrusion detector located on a wall at one end of the hallway, it will be readily apparent in advance that windows, doorways, hot air registers, and the like located along the sidewalls of the hallway will provide infrared radiation which would adversely affect the operation of the infrared sensor 20 as an intrusion detector. For such a situation standardized lens mask elements 92 and 94, shown in FIG. 17 may be applied to the lens 20 or to a lens mask 26. Similarly, standard lens mask elements (not shown) can be provided for use in other common situations such as the presence of baseboard heating elements along the entire wall opposite the location of an infrared sensor 20.

In some instances, the photographic image 78 produced by location of the camera 54 at a proposed sensor location may reveal an unacceptably large number of sources of infrared radiation likely to interefere with individual beams of sensitivity of the infrared sensor. In such a situation, the infrared sensor 20 may be mounted in a different sensor location or a slightly different orientation, and the effects of some or all of such sources of infrared radiation may be avoided. The degree of benefit to be obtained from adjusting the proposed position for an infrared sensor can be gauged in accordance with the present invention by making another photographic image using the camera 54 mounted in the receiver 29 after adjustment, and again examining the photographic image with the use of the overlay 72 or an equivalent manner of plotting the correspondence between the photographic image 78 and the infrared sensor. The process can be repeated additionally until a satisfactory location and orientation are obtained. The scale marks 27, provided on the ball 23, and the markings 96 on the overlay 72 preferably correspond to aid in gauging how much adjustment of the orientation of the sensor 20 (by moving the socket 31 of the receiver 29 relative to the ball 23 of the mounting bracket 21) is necessary in a particular location of the mounting bracket 21.

Figure 15:
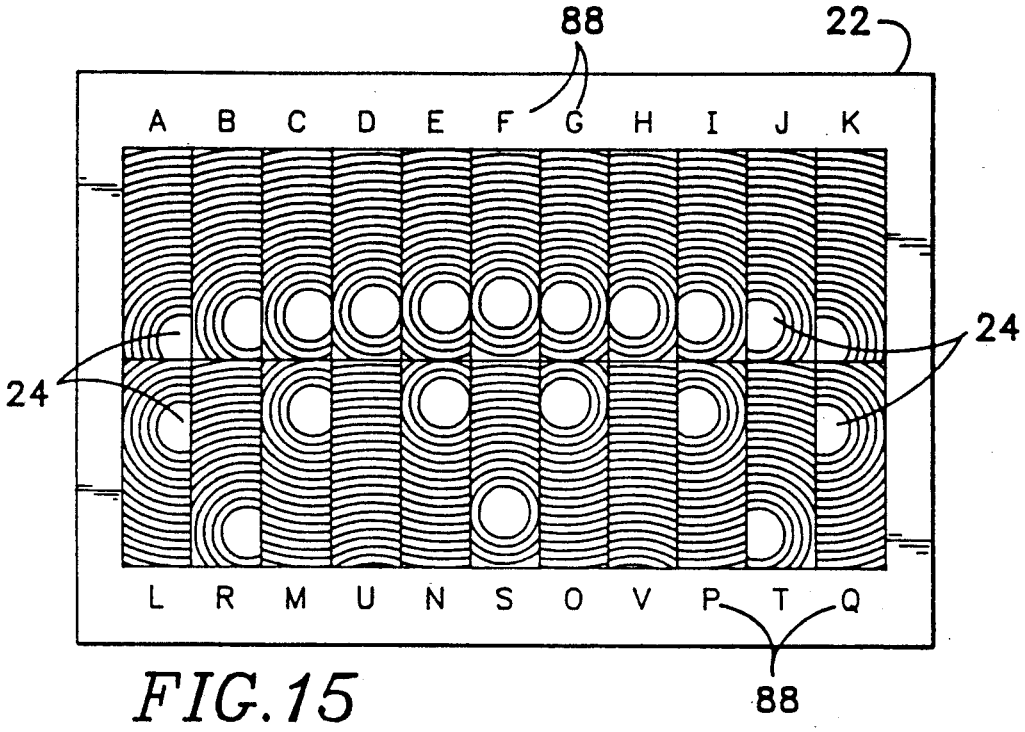
FIG. 15 is a front view of a compound lens for an infrared-sensitive sensor of the type shown in FIG. 1.
Figure 16:
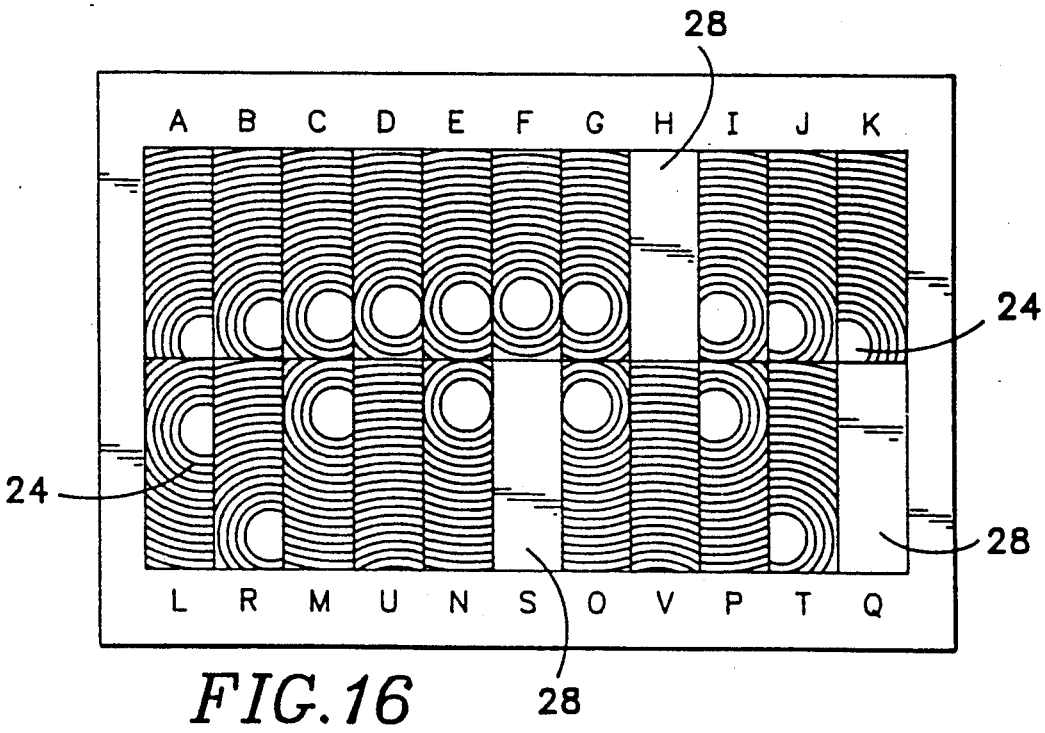
FIG. 16 is a view showing the compound lens shown in FIG. 15 with portions thereof masked in preparation for mounting in the infrared sensing device of FIGS. 1-5.
Figure 18:
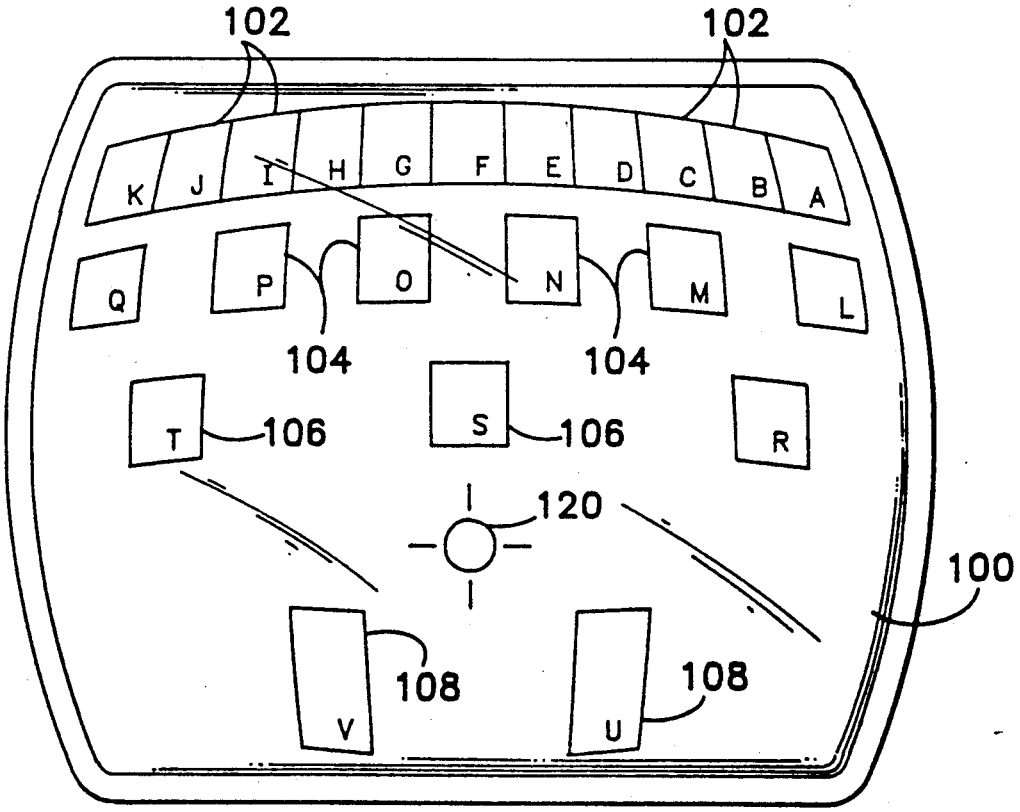
FIG. 18 is a front view of a convex mirror useful in accordance with the invention for previewing and adjusting the location and orientation of an infrared sensor as part of an intrusion detection system.
Figure 20:
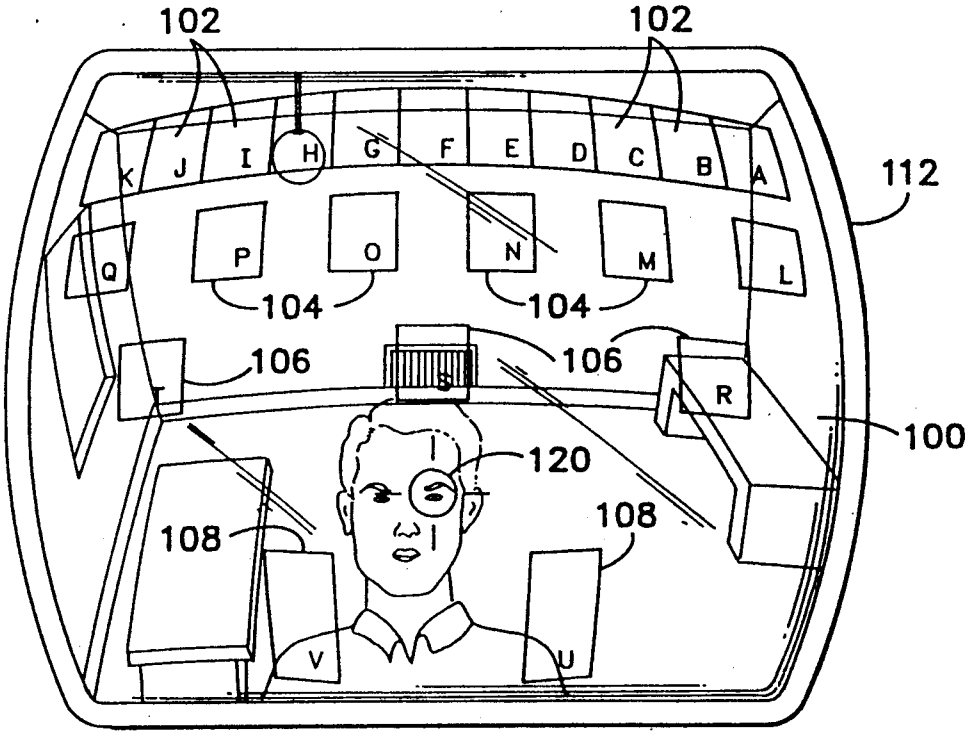
FIG. 20 is a view of the mirror shown in FIGS. 18 and 19, showing the image which would be seen by a person using the mirror to adjust the position and orientation of a mounting bracket for an infrared sensor in accordance with the present invention.
Figure 19:
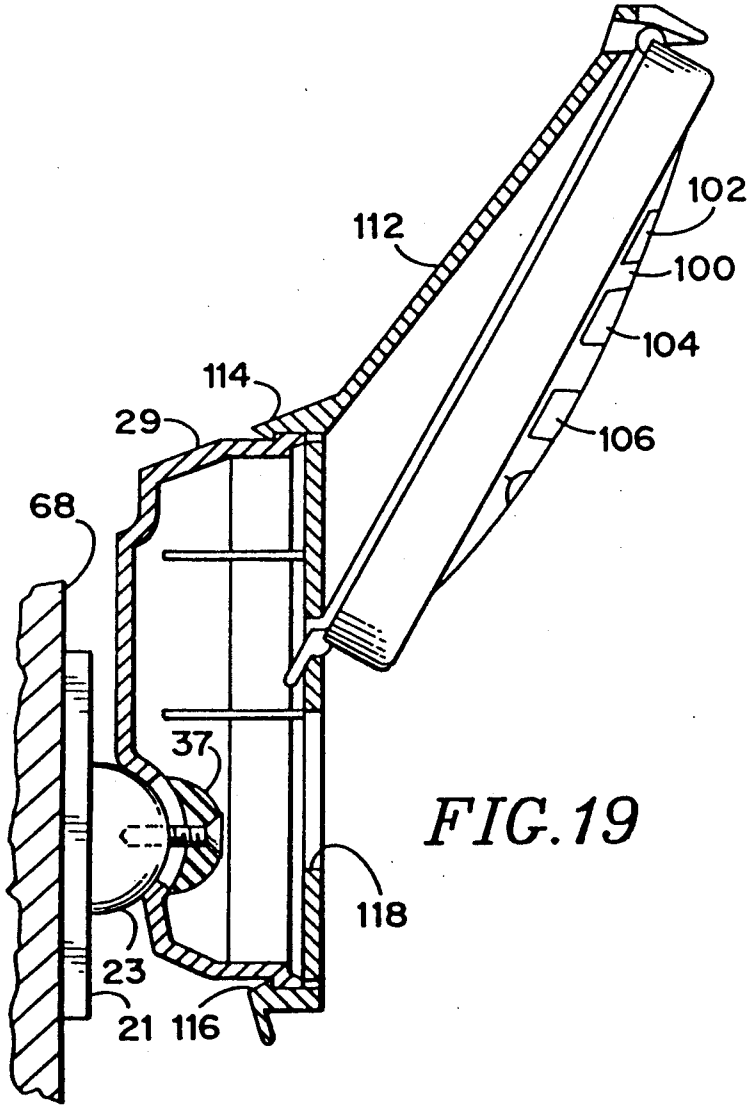
FIG. 19 is a sectional side view showing a portion of a wall and a mounting apparatus for an infrared sensor according to the invention and including a bracket supporting a convex mirror of the type shown in FIG. 18 for use during installation of the infrared sensing device.

As shown in FIGS. 18, 19 and 20, it is also possible to preview the field of coverage of the passive infrared sensor 20 by using a mirror 100, preferably a convex mirror, as shown in FIG. 18. Indicia 102, 104, 106, and 108 are provided on the surface of the mirror 100 to outline, in the reflected image seen in the mirror 100, each beam of sensitivity of the passive infrared sensor 20, so that an installer can preview the field of coverage of the sensor 20 and determine whether any recognized source of infrared radiation is located in a beam of sensitivity. When the mirror 100 is viewed from the appropriate position, the reflected image visible in the mirror 100 corresponds with the field of coverage of the passive infrared sensor 20, and each of the individual areas indicated by the indicia 102, 104, 106, and 108 corresponds with one of the elements of the compound Fresnel lens 22 (FIG. 15).

As shown in FIG. 19, the mirror 100 can be mounted upon the receiver 29, which is adjustably fastened to the mounting bracket 21 as a mounting assembly for the infrared sensor 20, by the use of the auxiliary mounting bracket 112. Resilient latches 114 and 116 fit over the receiver 29 in the same manner as does the rear housing 51 of the passive infrared sensor 20, so that the auxiliary mounting bracket 112 holds the mirror 100 in a position which has a known relationship to the position of a passive infrared sensor 20 mounted on the same receiver 29. The auxiliary mounting bracket 112 defines an opening 118 aligned with the retainer 37 and the associated screw used to clamp the receiver 29 in a desired position with respect to the hemispherical protrusion or ball 23.

An alignment guide index 120 is provided on the mirror 100 as a reference for viewing the reflected image of the field of coverage of the infrared sensor 20. The alignment guide index 120 is used as shown in FIG. 20, with the mounting bracket 21 mounted in a desired position, as, for example, being mounted on a wall 68. An installer located at about arm's length from the mirror 100, so that it is convenient to reach the screw and retainer 37 to adjust the position of the receiver 29 as necessary, will see an image reflected in the mirror 100 which corresponds with at least a portion of the field of coverage of the sensor 20, when he views the mirror 100 with one eye 122 aligned with the alignment guide index 120. That is, when the open eye 122 is visible within the circle which is a part of the alignment guide index 120, the reflected image seen in the mirror 100 through the eye 122 corresponds to at least a major portion of the field of coverage of the infrared sensor 20, and each of the indicia 102, 104, 106, and 108 correspond to respective ones of the individual beams of sensitivity defined by the several elements of the compound Fresnel lens 110.

The mirror 100 can be made of glass having a reflectively coated rear surface, with the indicia 102, 104, 106, and 108 printed on the front surface of the glass. It is preferable, however, because of the lesser expense involved, to provide a mirror 100 of precision molded plastic material with a reflective coating on its front surface and with the indicia 102, 104, 106 and 108 printed directly on the reflective surface. This provides the additional advantage of avoiding parallax which would be caused by the thickness of the glass and which would require additional compensation in plotting the indicia on the surface of the mirror 100, as will be appreciated.

Because the position of the observer's eye 122 is not precisely established merely by the observer being at about arm's reach of the retainer 37, with the eye 122 centered in the alignment index 120, each of the individual beams of sensitivity indicated by the indicia 102, 104, 106, and 108 is shown larger in size than the actual beams of sensitivity defined by the individual elements of the Fresnel lens 22. Nevertheless, should any apparent source of infrared radiation appear within the outline of any one of the segments of the indicia 102, 104, 106, or 108, a decision should be made as to adjustment of the position of the receiver 29 with respect to the ball 23 to avoid the potential source of infrared radiation, or the related element of the Fresnel lens 22 should be masked as previously described. Thus, as shown in FIG. 20, the lamp in section H, the hot air register in section S, and the window in section Q are all likely sources of infrared radiation which would require masking of the related elements of the Fresnel lens 22 shown in FIG. 15.

Alternatively, a more precise device might be provided for establishing the position of the installer's eye 122 for viewing the mirror 100, but only at increased expense, without significantly enhanced utility.

Once an acceptable position with respect to the ball 23 has been established for the receiver 29 and the receiver 29 has been secured by tightening the screw holding the retainer 37, a further check of the position providing a record of the initial installation position can be provided by utilization of the camera 54 to prepare a photograph of the field of view of the passive infrared sensor, as has been described previously. Because the camera 54 is able to provide a more precise definition of the field of view of the sensor 20, each of the individual beams of sensitivity of the sensor 20 may be shown as a smaller portion of the area of the photograph such as the photograph shown in FIG. 12. As a result, in some cases it may be possible to avoid having to mask one or more lens elements of the Fresnel lens 22 by making minor adjustments of the receiver 29 with respect to the ball 23 after the position of the receiver 29 has been established initially by use of the mirror 100 as held in place on the receiver 29 by the auxiliary mounting bracket 112.

Thus, the mirror 100 and its auxiliary mounting bracket 112 provide a faster way of previewing the field of coverage of the infrared sensor 20, while the use of the camera 54 provides a check for the position selected through use of the mirror 100, and potentially provides somewhat greater accuracy.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for installing an infrared radiation sensor having a predetermined zone of coverage and directional reception and defining at least one directional area of sensitivity, in order to prevent reception of infrared radiation from identifiable sources which would cause interference with the operation of said infrared radiation sensor, comprising:

(a) making a photographic image, photographed from a sensor location where said infrared radiation sensor is intended to be mounted, and showing at least a portion of said zone of coverage which said infrared radiation sensor would have when mounted in a sensor location;

(b) visually identifying in said photographic image a source of potentially interfering infrared radiation located in said zone of coverage; and (c) blocking reception by a sensor in said sensor location of infrared radiation from said source of potentially interfering infrared radiation visually identified from said photographic image.

2. The method of claim 1, including the further step of plotting on said photographic image an indication of the location that each of a plurality of directional areas defined by sensitivity of said infrared radiation sensor would have when said infrared radiation sensor is mounted in said sensor location.

3. The method of claim 1, including the steps of identifying a plurality of directional areas of sensitivity on said photographic image by using a camera located substantially in said sensor location to prepare said photographic image and thereafter superimposing on said photographic image, in a predetermined position, an overlay of transparent material on which is plotted each of a plurality of directional areas of sensitivity defined by said radiation sensor.

4. The method of claim 3, including the further step of providing indicia on said overlay and on said infrared radiation sensor to identify correspondence between portions of said overlay where said areas of sensitivity are plotted and respective portions of said sensor.

5. The method of claim 4 wherein the step of blocking reception includes the further step of masking the respective portion of said sensor which corresponds to a source of infrared radiation shown in said photographic image where one of said areas of sensitivity is plotted when said overlay is in said predetermined position with respect to said photographic image.

6. The method of claim 1 wherein said step of visually identifying a source of potentially interfering infrared radiation includes the step of correlating between said photographic image and said zone of coverage of said infrared radiation sensor by plotting an area of sensitivity of said infrared radiation sensor on said photographic image.

7. The method of claim 6 wherein said step of correlating includes plotting each of a plurality of directional areas defined by sensitivity of said infrared sensor on said photographic image.

8. The method of claim 6 wherein said step of correlating includes the step of placing an overlay over said photographic image to identify the portions of said photographic image which correspond to respective areas of sensitivity in the zone of coverage of said sensor.

9. The method of claim 8, including the further steps of providing corresponding indicia on said overlay and on a portion of said radiation sensor and masking said radiation sensor by applying infrared-opaque material to said radiation sensor in locations indicated by said indicia as corresponding to the portions of said photographic image identified as depicting sources of potentially interfering infrared radiation.

10. A method of evaluating a proposed location for installation of an infrared sensor, comprising:

(a) making a photographic image by receipt of light at a sensor location proposed for placement of an infrared sensor having a plurality of directionally oriented beams of sensitivity;

(b) plotting on said photographic image the location of at least one of said plurality of directionally oriented beams of sensitivity; and (c) visually determining from said photographic image whether a plotted location of any of said directionally oriented beams of sensitivity includes a source of undesirable infrared radiation.

11. The method of claim 10, including the step of preparing said photographic image by using a pinhole camera in said location proposed for placement of said infrared sensor.

12. The method of claim 11, including the step of preparing said photographic image by using an instant print camera in said location proposed for placement of said infrared sensor.

13. A method for preparing an infrared sensor defining a plurality of beams of sensitivity for installation in a predetermined sensor position, comprising:

(a) preparing a photographic image of an area visible from said predetermined sensor position;

(b) plotting a respective area representing at least one of said beams of sensitivity on said photographic image;

(c) for each beam of sensitivity plotted on said photographic image determining whether a source of potentially interfering infrared radiation is shown in said photographic image; and (d) making said infrared sensor insensitive to receipt of infrared radiation along each beam of sensitivity for which it has been determined that a source of potentially interfering infrared radiation is shown in said photographic image.

14. The method of claim 13, including the step of making said sensor insensitive to receipt of infrared radiation by masking a portion of said sensor with a self-adhesively attachable piece of infrared-opaque material.

15. The method of claim 13 wherein said sensor has a multi-element lens system including a plurality of elements each defining a respective directional beam of sensitivity of said infrared sensor, the method further comprising blocking transmission of infrared light through each element of said lens system defining a beam of sensitivity with respect to which a source of potentially interfering infrared radiation is shown in a corresponding area plotted on said photographic image, so as to prevent infrared radiation from reaching said sensor from said source.

16. Apparatus for previewing a zone of coverage of a directionally sensitive infrared sensing device from a proposed sensor location, comprising:

(a) photographic means for receiving light at a proposed sensor location where said sensing device is proposed to be placed and producing a photograph of an area to be monitored by said sensing device;

(b) plotting means for indicating on said photograph a directional beam of sensitivity of said sensing device, and for thereby facilitating a determination of whether a source of potentially interfering infrared radiation visible in said photograph is located within said beam of sensitivity of said sensing device located in said proposed sensor location.

17. The apparatus of claim 16 wherein said plotting means is a generally transparent overlay including reference means for positioning said overlay with respect to said photograph, and wherein said overlay includes indicia means for identifying said directional beam of sensitivity of said sensing device in said photograph.

18. The apparatus of claim 16 wherein said directionally sensitive infrared sensing device is sensitive to infrared radiation along a plurality of directional beams of sensitivity, further comprising identifying indicia means included in said plotting means for correlating each of said plurality of directional beams of sensitivity to a respective portion of said photograph.

19. The apparatus of claim 18 wherein said indicia means correlates each of said plurality of directional beams of sensitivity specifically to a respective portion of said photograph.

20. The apparatus of claim 16 wherein said infrared sensing device includes a sensitive element and lens means for focusing infrared radiation onto said sensitive element from a source located within a directional beam of sensitivity of said infrared sensing device, and wherein said plotting means includes means for indicating correspondence between a portion of said lens means defining said directional beam of sensitivity and said photograph.

21. The apparatus of claim 16 wherein said infrared sensing device includes a sensitive element and a compound lens including a plurality of lens elements each arranged to transmit infrared radiation from a respective directional beam of sensitivity to said sensitive element in said sensor, said plotting means including means for specifically indicating correspondence between a portion of said photograph and a beam of sensitivity defined by a respective lens element of said compound lens.

22. The apparatus of claim 16 wherein said photographic means is a camera including means for orienting said camera in a direction bearing a predetermined relationship to a proposed orientation of said infrared sensing device.

23. Apparatus for use in installing an infrared sensor responsive to infrared radiation received along at least one directional beam of sensitivity, comprising:

(a) light gathering means for receiving light at a proposed sensor location where said sensor is proposed to be placed and producing a photograph of an area to be monitored by said sensor;

(b) plotting means for indicating on said photograph said at least one directional beam of sensitivity of said sensor, and for indicating whether a source of infrared radiation visible in said photograph is located within said at least one directional beam of sensitivity of said sensor located in said proposed sensor location; and (c) means for blocking transmission of infrared radiation to said sensor along said at least one beam of sensitivity identified through use of said plotting means as including said source of infrared radiation visible in said photograph.

24. The apparatus of claim 23 wherein said light gathering means is a camera capable of producing photographs without the use of separate film processing equipment.

25. Apparatus for use in preparing for installation of an infrared sensing device having a field of view for use as part of a security maintenance system, comprising:

(a) means for producing a photograph representative of the field of view of said infrared sensing device; and (b) plotting means for identifying particular portions of said photograph and correlating said portions of said photograph with respective portions of said field of view covered by said sensing device.

26. The apparatus of claim 25 wherein said infrared sensing device is sensitive to infrared radiation along directional beams of sensitivity and wherein said particular portions of said photograph identified by said plotting means correspond with respective ones of said beams of sensitivity to infrared radiation.

27. The apparatus of claim 26, further including means for preventing effective reception of infrared radiation by said infrared sensing device along selected ones of said beams of sensitivity from infrared sources identified in said particular portions of said photograph.

28. The apparatus of claim 25, including alignment means, associated with said means for producing a photograph, for establishing a predetermined relationship between said photograph and said field of view of said infrared sensing device.

29. The apparatus of claim 28, further including mask means for attachment to said infrared sensing device, said mask means including a plurality of mask sectors each corresponding to a respective one of a plurality of beams of sensitivity defined by said infrared sensing device, and individual ones of said mask sectors having a correspondence with individual ones of said particular portions of said photograph identified by said plotting means.

30. The apparatus of claim 25 wherein said plotting means comprises an overlay for identifying said particular portions of said photograph, said overlay and said mask including corresponding indicia for correlating respective ones of said mask sectors with particular ones of said particular portions of said photograph.

31. The apparatus of claim 25 wherein said infrared sensing device includes compound lens means including a plurality of lens elements for receiving infrared radiation from each of a plurality of directional beams of sensitivity and focusing said infrared radiation on a sensitive element of said infrared sensing device, said apparatus further including mask means for preventing reception of infrared radiation through a selected one of said lens elements corresponding to a selected one of said particular portions of said photograph identified by said plotting means.

32. The apparatus of claim 31, including mask means for attachment to said infrared sensing device for reducing said field of view of said infrared sensing device to predetermined angular dimensions.

33. The apparatus of claim 32 wherein said mask means includes a plurality of individually delineated easily separable mask elements each corresponding to the shape of a predetermined one of said lens elements of said infrared sensing device.

34. The apparatus of claim 31 wherein said plotting means and said mask means include corresponding indicia for indicating correspondence of a mask element with a respective lens element and a respective one of said particular areas identified in said photograph by said plotting means.

35. Apparatus for previewing a zone of coverage of a directionally sensitive infrared sensing device from a proposed sensor location, comprising:

(a) mirror means located proximate a proposed sensor location, for receiving visible light and for providing an observer a reflected view of an area to be monitored by said infrared sensing device;

(b) alignment means associated with said mirror means for indicating when an eye of said observer is in a predetermined viewing position with respect to said mirror means; and (c) indicia means associated with said mirror means and visible to said observer when said eye is in said viewing position, for indicating the location of a directional beam of sensitivity of said sensing device and for facilitating a determination of whether a potential source of interfering infrared radiation visible to said observer as a reflected image in said mirror means is located within said beam of sensitivity of said sensing device located in said proposed sensor location.

36. The apparatus of claim 35 wherein said indicia means comprises means for defining a pattern located on a surface of said mirror means.

37. The apparatus of claim 35 wherein said mirror means includes a reflective surface and said indicia means are located on said reflective surface.

38. The apparatus of claim 35 wherein said alignment means includes an alignment index on said mirror and visible in a predetermined apparent relationship to a reflected image of the observer's eye when the observer's eye is in said viewing position with respect to said mirror means.

39. The apparatus of claim 38 wherein said mirror means includes a convex mirror and said alignment index defines an area upon said convex mirror within which said observer can see said eye when said eye is in said viewing position.

40. The apparatus of claim 35 including a mounting bracket having an adjustable portion for supporting said mirror means and permitting adjustment of the orientation of said mirror means, said mounting bracket including means for holding said infrared sensing device in a predetermined position with respect to the position of said mirror means.

41. The apparatus of claim 35 wherein said directionally sensitive infrared sensing device is sensitive to infrared radiation along a plurality of directional beams of sensitivity, further comprising identifying means included in said indicia means, for correlating each of said plurality of directional beams of sensitivity to a respective portion of an image reflected in said mirror means.

42. The apparatus of claim 41 wherein said indicia means identifies each of said plurality of directional beams of sensitivity specifically to a respective portion of said reflected image.

43. The apparatus of claim 35 wherein said infrared sensing device includes a sensitive element and lens means for focusing infrared radiation onto said sensitive element from a source located within a directional beam of sensitivity of said infrared sensing device, and wherein said indicia means includes means for indicating correspondence between a portion of said lens means defining said directional beam of sensitivity and a corresponding portion of a reflected image seen in said mirror means by said observer.

44. The apparatus of claim 35 wherein said infrared sensing device includes a sensitive element and a compound lens including a plurality of lens elements each arranged to transmit infrared radiation from a respective directional beam of sensitivity to said sensitive element in said sensing device, said indicia means including means for specifically indicating correspondence between a portion of said reflected image seen in said mirror means and a beam of sensitivity defined by respective one of said plurality of lens elements of said compound lens.

45. The apparatus of claim 35 wherein said mirror means includes a reflective surface, said apparatus further including means for orienting said reflective surface in a direction bearing a predetermined relationship to a proposed orientation of said infrared sensing device.

46. A method for evaluating a proposed location for an infrared sensing device and for adjusting the orientation of said infrared sensing device, comprising:

(a) mounting a support bracket in a proposed location for an infrared sensing device;

(b) mounting a mirror, including indicia representative of the limits of each of a plurality of directional beams of sensitivity of said infrared sensing device, on a movable portion of said support bracket in a predetermined relationship to said movable portion of said support bracket;

(c) from a predetermined position with respect to said mirror, observing an image reflected in said mirror and observing with respect to said image the location of each of said directional beams of sensitivity as represented by said indicia;

(d) adjusting said movable portion of said support bracket as necessary to place said mirror in a position in which observing said reflected image in said mirror with reference to said indicia indicates that each of said directional beams of sensitivity is located in an acceptable orientation;

(e) securing said movable portion of said support bracket in said position; and (f) mounting said infrared sensing device on said movable portion of said support bracket.

* * * * *

UNITED STATES PATENT AND TRADEMARK OFFICE

CERTIFICATE OF CORRECTION

PATENT NO. : 5,026,990

DATED : June 25, 1991

INVENTOR(S) : Douglas H. Marman et al.

It is certified that error appears in the above-identified patent and that said Letters Patent is hereby corrected as shown below:

Col. 7, line 48 After "used to" delete --30--.

Signed and Sealed this

Sixteenth Day of February, 1993

*Attest:*

STEPHEN G. KUNIN

*Attesting Officer*

*Acting Commissioner of Patents and Trademarks*